United States Patent [19]

Pfenning et al.

[11] Patent Number: 4,488,764

[45] Date of Patent: Dec. 18, 1984

[54] PORTABLE SECURITY CONTAINER FOR AN ELECTRICAL CORD AND ATTACHED PLUG

[76] Inventors: Bruno A. Pfenning; Doris P. Pfenning, both of 520 Hummingbird La., Deerfield, Ill. 60015

[21] Appl. No.: 397,489

[22] Filed: Jul. 12, 1982

[51] Int. Cl.[3] ..... H01R 13/514

[52] U.S. Cl. ..... 339/37; 70/57; 70/63; 339/82

[58] Field of Search ..... 339/36, 37, 82; 70/57, 70/63

[56] References Cited

U.S. PATENT DOCUMENTS

| | | | |
|---|---|---|---|
| 2,643,787 | 6/1953 | Rockman | 220/3.2 |
| 3,131,985 | 5/1964 | Blonder | 339/37 |
| 3,293,588 | 12/1966 | Blonder | 339/37 |
| 3,636,742 | 1/1972 | Raney | 70/63 |
| 4,311,883 | 1/1982 | Kidney | 339/37 |

*Primary Examiner*—Joseph H. McGlynn
*Assistant Examiner*—Paula Austin
*Attorney, Agent, or Firm*—Dressler, Goldsmith, Shore, Sutker & Milnamow, Ltd.

[57] ABSTRACT

Apparatus is provided for preventing unauthorized use of an electrically operated appliance or device having an electrical cord and attached plug. The preferred embodiment of the apparatus includes a container to receive an electrical cord and attached plug. The container has at least two slots formed in its sidewalls. A cover is provided with a locking means and can be positioned in an open or closed position with respect to the container to allow for deposit or removal of the electrical cord and attached plug. When the plug is positioned in the container, the cover can be closed and locked to prevent unauthorized use of the plug. When the plug is in use, the cord can be received within the two slots with the cover closed and locked to retain the container on the cord during such use.

4 Claims, 11 Drawing Figures

FIG. 10
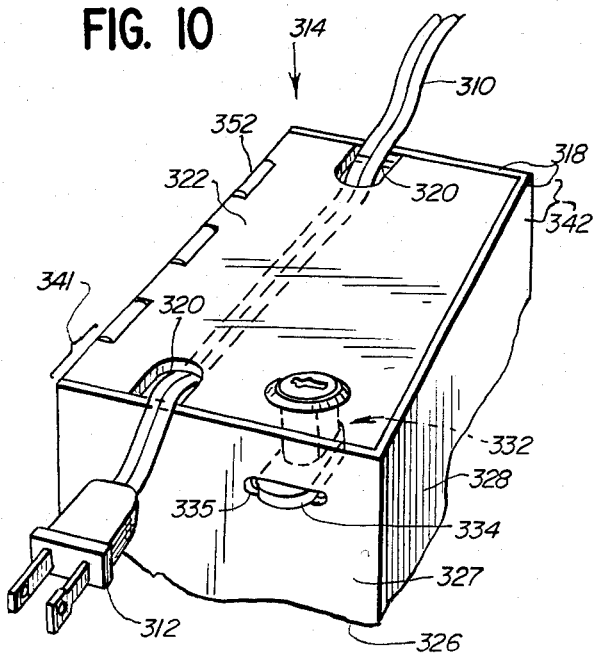
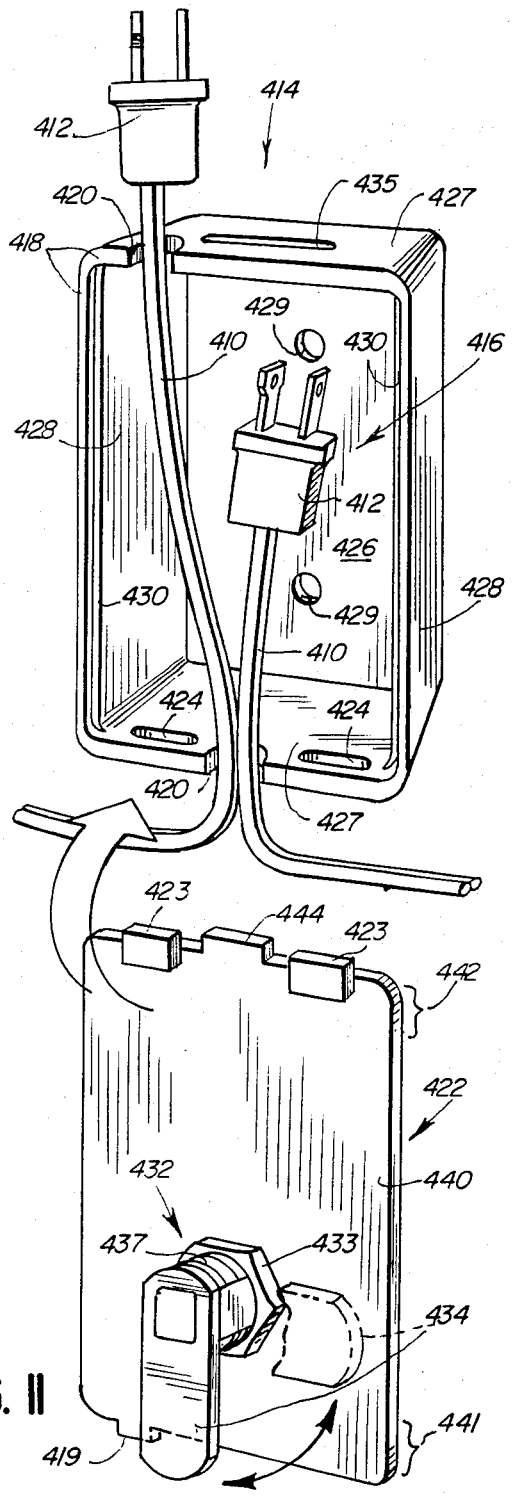
FIG. 11

PORTABLE SECURITY CONTAINER FOR AN ELECTRICAL CORD AND ATTACHED PLUG

TECHNICAL FIELD

This invention relates, in general, to portable security containers for preventing the unauthorized use of an electrically operated appliance or device having an electrical cord and attached plug.

BACKGROUND OF THE INVENTION

Various devices have been proposed for preventing the unauthorized use of an electrical cord and attached plug. These devices can be categorized in five groups: (1) key locked electrical switches (see for example U.S. Pat. Nos. 1,656,586 and 3,453,402); (2) key locked electrical plugs (see for example U.S. Pat. Nos. 2,759,159; 2,761,028; 2,879,494; 3,345,603 and 3,453,402); (3) locking cover assemblies for electrical wall receptacles (see for example U.S. Pat. Nos. 2,709,198; 2,987,909; 3,096,409; 3,131,985; 3,200,989; 3,293,588 and 3,660,798;) (4) key locked electrical receptacles for appliance cord plugs (see for example U.S. Pat. Nos. 3,524,092 and 4,063,110); and (5) key locked devices for enclosing part or all of an appliance cord plug (see for example U.S. Pat. Nos. 2,643,787; 2,654,073; 2,733,416 and 2,955,272).

The electrical switch devices of the first group have the disadvantage of requiring initial fabrication as part of the appliance cord or severing of the appliance cord and subsequent installation. Such installation of the key lock switch generates increased labor costs and requires additional time compared with other devices that do not require connection directly to the appliance cord.

The devices of the second group possess the disadvantage of replacing the original plug with which the appliance was manufactured. The substitution of plugs creates increased costs, installation time, and inconvenience that would not otherwise be incurred.

The devices of the third group suffer the disadvantage of being associated with a particular stationary electrical wall receptacle and of thereby not being readily portable with one particular appliance. In addition, these inventions can not be retained on, or carried with, a particular electrical appliance's plug or cord when the appliance is not being used. Therefore such security devices, if designed to be otherwise separately portable, are very susceptible to loss or misplacement during transport of the particular electrical appliance.

The apparatus of the fourth group have the disadvantage of being cumbersome, somewhat complex, and relatively more costly as they include an electrical receptacle within a security container. Further, these devices are not as conveniently portable as may be desired owing to their typically larger mass and bulk.

The devices disclosed by the patents of the fifth group all have the disadvantage of lacking the capability to be retained on the cord or plug of the electrical appliance when the device is not being used to prevent the unauthorized use of the appliance. Therefore, such devices can be more easily lost or misplaced when the appliance is in use and the device is not performing its designated function. In addition, some of the devices disclosed by the patents of this group require the use of various springs and sliding switches to facilitate their operation (e.g., U.S. Pat. Nos. 2,654,073 and 2,733,416). Others include separable components (e.g., U.S. Pat. No. 2,643,787). The use of springs and switches and/or the use of separable multi-piece structures can increase production costs, as well as the costs associated with the marketing and servicing of such devices.

Until the present invention, the various disadvantages associated with the above-discussed types of security devices tended to make the use of such devices less convenient than desired and tended to inhibit the wide spread use of such devices.

It would be beneficial to provide an improved security device that would not have to be electrically connected to the cord or plug of the appliance. Elimination of such an installation requirement would reduce the time necessary to use the device and eliminate inconvenience associated with such installations in general.

It would also be desirable with such an improved portable security container to provide a means for attaching the container to the cord or the plug of the electrical appliance, to ensure against the loss or misplacement of the container during use or non-use of the appliance.

SUMMARY OF THE INVENTION

The security container incorporating the present invention, among other things, substantially eliminates these disadvantages by providing a security container that can be retained on the appliance cord and that can be readily transported with a particular electrical appliance. This prevents the security container from being lost or misplaced when it is not in use to prevent unauthorized connection of the appliance to an electrical outlet or receptacle.

In the illustrated embodiments of the present invention a container is provided for receiving at least a portion of an electrical cord and attached plug. The container is adapted to permit the placement of the electrical plug in, or the removal of the electrical plug from, the interior or storage volume of the container.

The container is also adapted to receive a portion of the cord extending through the storage volume of the container. The cover and/or the container define at least two slots in communication with the storage volume of the container to receive a portion of the cord within the storage volume and to permit the cord to extend out of the storage volume at each end of the container.

In the illustrated embodiments, the cover is adapted to be positioned in an open or a closed position relative to the container. In addition, locking means is included to lock the cover in the closed position on the container.

This apparatus permits a distal portion of the cord and attached plug to be located within the storage volume and another portion of the cord to be located within one of the slots while the cover is in a closed and locked position. In addition, the cover can be unlocked and opened to allow the cord and attached plug to be removed from the storage volume.

Further, even when the plug is exterior of the container (as when it is in use in an electrical receptacle), a portion of the cord can be disposed within the slots and through the storage volume of the container. Then, the cover can be locked in a closed position so that the container is retained on the cord.

Numerous other advantages and features of the present invention will become readily apparent from the following detailed description of the invention and embodiments thereof, from the drawings and the the appended claims.

BRIEF DESCRIPTION OF THE DRAWINGS

In the accompanying drawings forming part of the specification and in which like numerals are employed to designate like parts throughout the same.

FIG. 10 is a perspective view of a third embodiment of the container showing alternate positioning of the slots and the locking means; and FIG. 11 is a perspective view of a fourth embodiment of the container with the cover in the open position and showing two cords with attached plugs, one of which is disposed in the use position and one of which is disposed in the non-use position.

DESCRIPTION OF THE PREFERRED EMBODIMENTS

Figure 1:
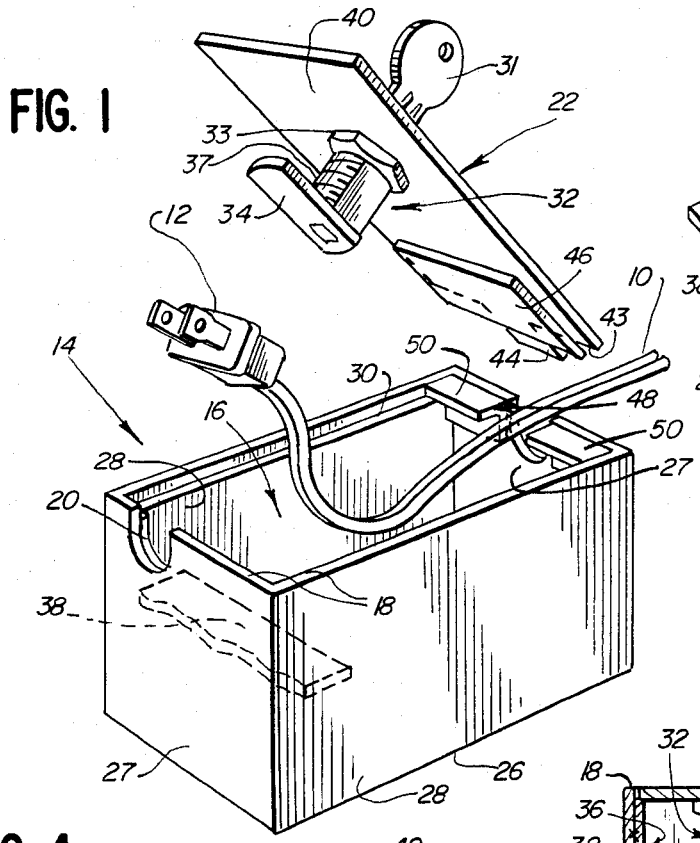
FIG. 1 is a perspective view of a first embodiment of the container of the present invention with the cover in the open position.

While this invention is susceptible of embodiment in many different forms, there are shown in the drawings and will be described in detail, preferred embodiments of the invention. It should be understood, however, that the present disclosure is to be considered as an exemplification of the principles of the invention and is not intended to limit the invention to the embodiments illustrated.

In the following description, two digit numerals are used to refer to the embodiment illustrated in FIGS. 1, 2, 3, 4, 5 and 6; three digit numerals in the one hundred series are used to refer to the alternate form of the locking means in FIG. 7; three digit numerals in the two hundred series are used to refer to the second embodiment illustrated in FIGS. 8 and 9; three digit numerals in the three hundred series are used to refer to the third embodiment illustrated in FIG. 10; and three digit numerals in the four hundred series are used to refer to the fourth emboiment illustrated in FIG. 11. The same last two digits in each numeral designate similar or functionally analogous elements in the various embodiments.

The several examples of the present invention are described in detail below. These examples are included merely to aid in the understanding of the invention and variations may be made by one skilled in the art without departing from the spirit and scope of the invention.

The first embodiment of the device of the present invention is illustrated in FIGS. 1–6 and comprises container 14 that defines a storage volume 16 and a cover 22 which is adapted to cover the storage volume 16. The container is adapted to receive the cord 10 and attached plug 12 of an electrically operated appliance or other device.

The container 14 comprises a plurality of peripheral wall means, such as two opposed end walls 27, two opposed sidewalls 28, and a bottom wall 26. The walls 27 and 28 each have a top edge 18 and the top edges 18 define an opening to the storage volume 16 of the container.

Each of the end walls 27 defines a slot 20 that is open to the top edge 18 of the container 14 and communicating with said storage volume 16. The slots 20 are of a size and configuration that prevents passage therethrough of the electrical plug 12, while being large enough to allow passage of the electrical cord 10 to which the plug 12 is attached. Preferably, the slots 20 are of a size to permit near frictionless sliding of the cord 10 through slots 20. In the alternative, the slots 20 could be of a size to permit sliding of the cord 10 through the slots 20 with a maximum amount of friction exerted by the slots 20 on the cord 10.

Figure 2:
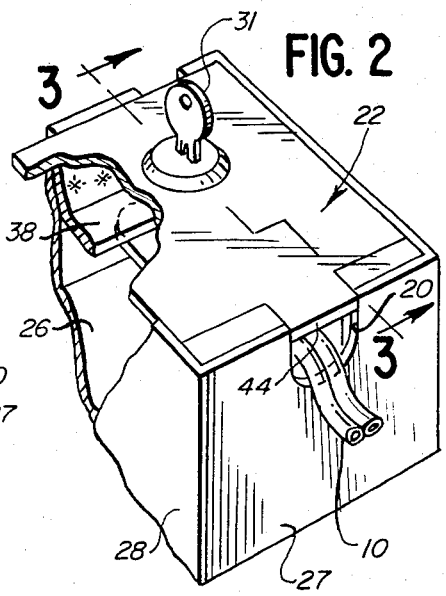
FIG. 2 is a fragmentary, perspective view of the container of FIG. 1 (but rotated about 90°) with portions of the structure broken away to better illustrate interior detail and showing the cover in a closed position on the container and a portion of the cord disposed within one of the slots.

The container 14 includes a support shoulder 30 formed in at least one of the sidewalls 28 or end walls 27 to support the cover 22 while it is in the closed position over the storage volume 16 of the container 14 (as in FIG. 2). Preferably, the shoulder 30 extends around most of the interior of the container 14.

The container 14 further includes a locking catch 36 (FIG. 3) on one of the end walls 27 with a horizontally extending member 38 to facilitate locking the cover 22 closed in a manner described in detail hereinafter.

Figure 3:
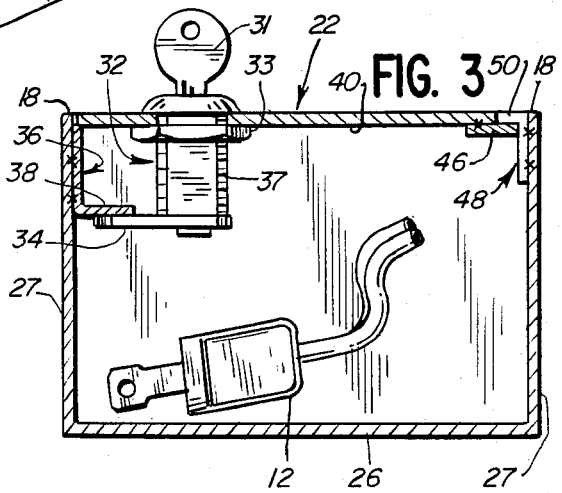
FIG. 3 is a cross-sectional view taken generally along the planes 3—3 of FIG. 2 showing the distal portion of the cord and attached plug within the storage volume.
Figure 6:
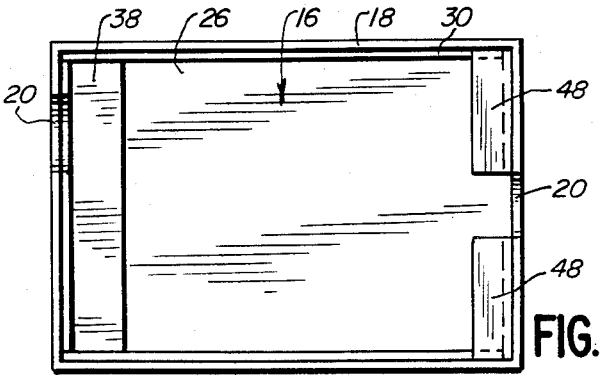
FIG. 6 is a top view of the container with the cover removed.

As best illustrated in FIG. 3, a retaining plate 48 is mounted to one of the end walls 27 and has a horizontal retaining member 50 to facilitate the securing of the cover 22 in the closed position over the storage volume 16 of the container 14 as best shown in FIGS. 1, 3 and 6. Preferably, two spaced-apart retaining members 50 are provided on either side of the slot 20 in the end wall 27.

Figure 4:
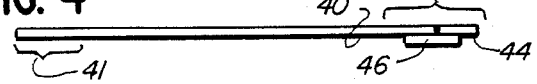
FIG. 4 is a side view of the cover but without the locking means shown for ease of illustration.
Figure 5:
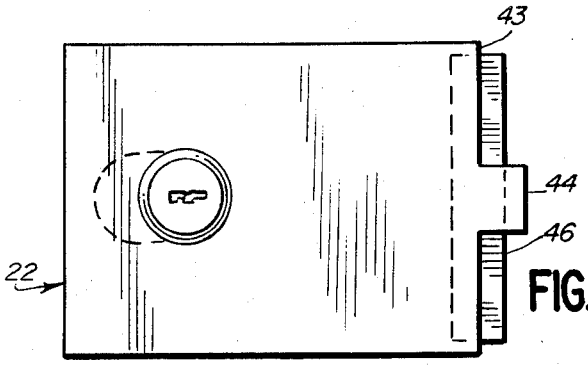
FIG. 5 is a top view of the cover with the locking means shown thereon.

The cover 22 can be locked on the container 14 in a closed position to preclude the opening and access to storage volume 16 as best illustrated in FIGS. 3–5. Specifically, the cover 22 is preferably provided with a key-operated lock 32 that can be actuated with a key 31. The lock 32 may be of the conventional type having a cylinder 37 mounted to and protruding through the cover 22 and held to the cover 22 with a retaining nut 33.

The key-operated lock 32 includes a rotatable arm 34 on the end of the protruding portion of the cylinder 37. The arm 34 extends laterally outwardly and can be rotated by key 31 from the latching position illustrated in FIG. 3 to an unlatched position about 90 to 180 degrees from the illustrated latching position.

When the cover is in the closed position over the storage volume 16, the rotatable arm 34 can be rotated under the horizontal member 38 of locking catch 36 to lock the cover 22 in the closed position over the storage volume 16 of container 14.

The cover 22 is preferably a generally rectangular plate with first end 41 and a second end 42 (as best shown in FIG. 4). The cover 22 has a bottom surface 40 and defines a latching edge 43 along the second end 42. The cover 22 further includes a tab 44 extending outwardly from the latching edge 42 and a flange 46 parallel to and below the bottom surface 40. The flange 46 extends outwardly from the latching edge 42 below the tab 44.

When the cover 22 is in the closed position on the container 14, the tab 44 covers one of the slots 20 as illustrated in FIG. 2.

As shown in FIG. 3, when cover 22 is in the closed position it is positioned flush with the top edges 18 of the container walls and with the horizontal retaining members 50 while the flange 46 is positioned below the horizontal retaining members 50.

As shown in FIG. 1, when the cover 22 is in an open position spaced away from the opening of the storage container 14, the cord 10 can be positioned within one of the slots 20 and the attached plug 12 can be positioned within the storage volume 16 of container 14. The cover 22 can then be disposed in the closed position and locked to the container 14 so that the cord 10 will be retained within the slot 20 while the plug 12 will be retained within the storage volume 16 of container 14 as best shown in FIGS. 2 and 3.

To this end, the rotatable arm 34 of the key-operated lock 32 is positioned below the horizontally extending member 38. Thus, the cover 22 is prevented from being removed from the container 14.

The cover 22 can be unlocked when desired with the key 31. When the container 14 is opened, the plug 12 can then be removed from the storage volume 16 and the cord 10 can be positioned within both of the slots 20. The cover 22 can then be again placed on the container 14 in the closed position and locked closed with key 31. This allows the container 14 to be retained on the cord 10 when the plug is in use.

Figure 7:
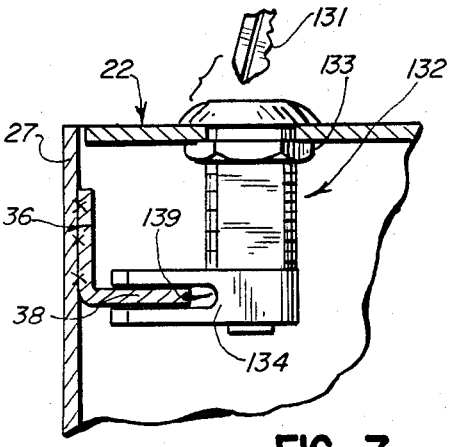
FIG. 7 is an enlarged, fragmentary, cross-sectional view of an alternate form of the locking means.

FIG. 7 illustrates an alternate form of a key-operated lock 132 similar to lock 32 described above with reference to FIGS. 1–3. Specifically, the lock 132 has a rotatable arm 134 defining a groove 139 for receiving the member 38 of the container. When the arm 134 is rotated to the locked position with the cover 22 in the closed position, the rotatable arm 134 engages the horizontally extending arm 38 and prevents removal of the cover 22.

Figure 8:
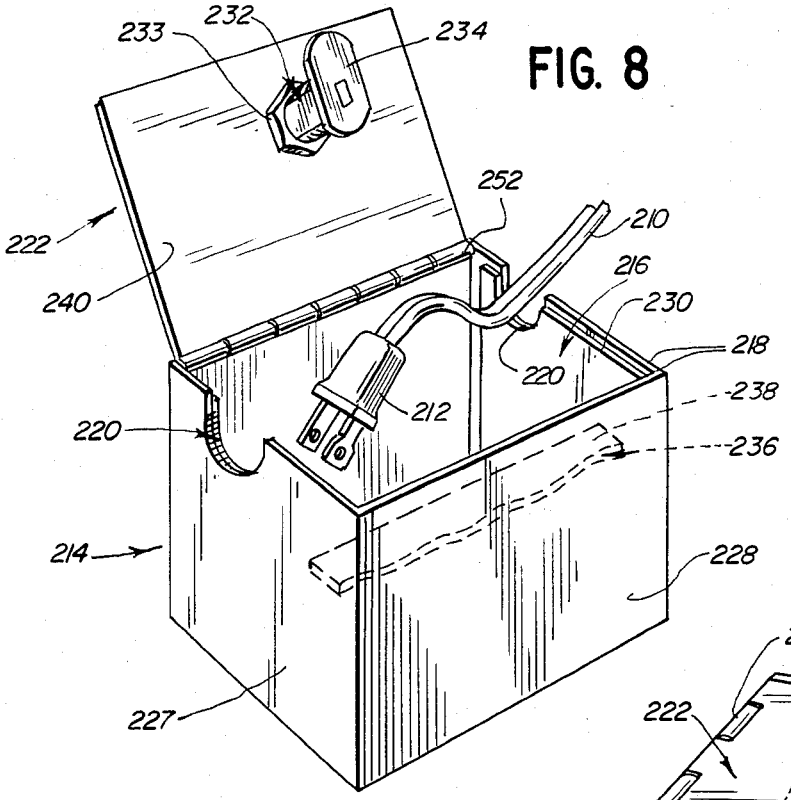
FIG. 8 is a perspective view of a second embodiment of the container with a cover hingedly mounted thereon and shown in the open position.
Figure 9:
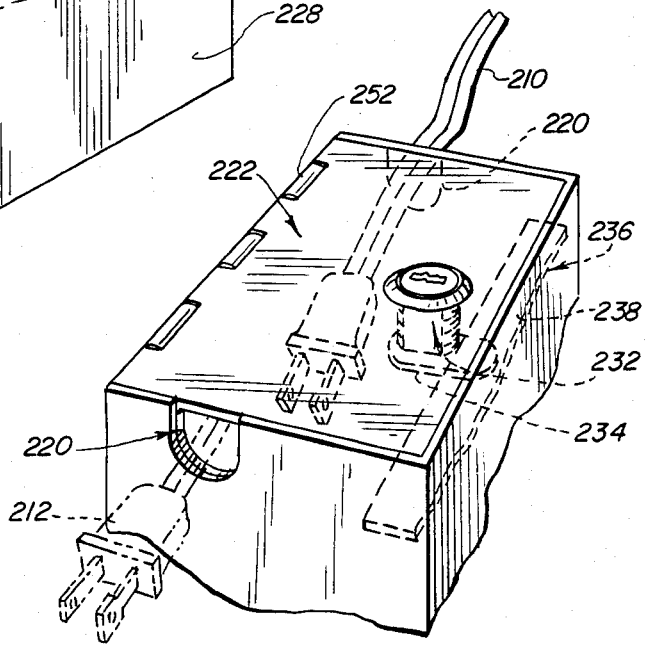
FIG. 9 is a fragmentary, perspective view of the container of FIG. 8 with the cover in the locked closed position and with the cord and attached plug shown in two phantom positions with dashed lines.

A second embodiment of the invention is shown in FIGS. 8 and 9 which includes a cover 222 connected to the container 214 with a hinge 252. The hinge 252 is mounted to the top edge 218 of one of the side walls 228.

The cover 222 includes a key-operated lock 232 that may be of the conventional type having a cylinder 237 mounted to and protruding through the cover 222. The key-operated lock 232 is held to the cover 222 with retaining nut 233.

Further, the cover 222 can be pivoted between an open position spaced away from the opening of the storage container, as shown in FIG. 8, and the closed position over the storage volume 216, as shown in FIG. 9.

As shown in FIG. 8, when the cover 222 is in an open position pivoted away from the opening of the container 214, the cord 210 can be positioned within one of the slots 220 included in the end walls 227 and the attached plug can be positioned within the storage volume 216 of container 214. The cover 222 can then be pivoted to the closed position and a rotatable arm 234, included on the protruding end of key-operated lock 232, can be rotated under the horizontal member 238 of locking catch 236, locking the cover 222 to the container 214. This allows the cord 210 to be retained within slot 220 while the plug 212 will be retained within the storage volume 216 of the container 214 as best shown by the phantom positioning of the plug and cord with dashed lines in FIGS. 8 and 9.

The cover 222 can be unlocked when desired. When the cover 222 is pivoted to the open position, the plug 212 can then be removed from the storage volume 216 and the cord 210 can be positioned within both of the slots 220. The cover can then again be pivoted to the closed position on the container and locked closed. This allows the container 214 to be retained on the cord 210 when the plug 212 is in use as best shown by the phantom positioning of the plug and cord in FIG. 9.

A third embodiment of the invention is shown in FIG. 10 which includes a cover 322, as well as a bottom wall 326, two end walls 327 and two sidewalls 328 defining a container 314. The cover 322 is hingedly mounted to one of the sidewalls 328 at the top edge 318 of the sidewall 328 with hinge 352.

The cover 322 includes a key-operated lock 332 protruding through and fixed to the cover 322 and having a rotatable arm 334 spaced below the cover. The cover 322 also includes slots 320 for reception of the cord 310 while the plug 312 is within the container 314 or external to the container for use. The positioning of the cord 310 and plug 312 is substantially identical to that described above for the cord 10 and the plug 12 of the first embodiment with reference to FIGS. 1–6.

One of the endwalls 327 includes an elongated aperture 335. When the cover 322 is pivoted to the closed position, the rotatable arm 334 may be positioned to be disposed within the aperture 335 to facilitate locking the cover 322 to the container 314. This allows the container 314 to be locked on the cord 310 with the plug 312 exterior of the container 314 or allows the plug 312 to be locked within the container 314 in the manner described above for the first embodiment of the container 14.

A fourth embodiment of the invention is shown in FIG. 11 which includes a cover 422 and a container 414 having a bottom wall 426, two end walls 427 and two sidewalls 428. The bottom wall 426 defines two holes 429 suitable for allowing the container 414 to be mounted with screws to a wall, shelf, or the like. Each of the two sidewalls 428 define a support ledge 430. The bottom wall 426, the two end walls 427 and the two sidewalls 428 together define a storage volume 416. The container 414 is illustrated with two plugs 412, each on a separate cord 410.

Each of the end walls 427 defines a slot 420 that is open to a top edge 418 of the container 414. In addition, one of the end walls 427 includes two spaced-apart apertures 424 positioned on either side of the slot 420 while the other end wall 427 defines an elongated horizontal aperture 435.

The cover 422 is preferably a generally rectangular plate with a first end 441 and a second end 442. The cover 422 has a bottom surface 440 and defines a latching edge 443 along the second end 442. The cover 422 includes a tab 444 extending outwardly from the latching edge 443 of the cover 422. The cover 422 further includes a pair of fingers 423 projecting outwardly from the second end 442, below the bottom surface 440 and on either side of the tab 444. The cover 422 also includes a projection 419 extending outwardly from the first end 441 of the cover 422.

The cover 422 includes a key-operated lock 432 of the conventional type having a cylinder 437 mounted to and protruding through the cover 422 at the first end 441. The key-operated lock 432 is secured to the cover 422 with a retaining nut 433 and includes a rotatable arm 434. The rotatable arm 434 extends laterally outward from the cylinder 437 and can be rotated from a latched position to an unlatched position about 90 to 180 degrees from the latching position. This is best shown in FIG. 11 by phantom positioning of the rotatable arm 434 in the unlatched position with dashed lines.

As shown in FIG. 11, when the cover 422 is in an open position away from the storage volume of the container 416, the cord 410 can be positioned within one of the slots 420 and the attached plug 412 can be positioned within the storage volume 416. The cover 422 can then be positioned in the closed position over the storage volume 416 for being supported by the support ledges 430. When the cover 422 is in the closed position, the fingers 423 are positioned within the two spaced-apart apertures 424, the tab 444 is positioned over the slot 420 in one of the end walls 427, and the projection 419 is positioned over the slot 420 in the opposite end wall 427. When the cover 422 is in the closed position, the rotatable arm 434 of the key-operated lock 432 can be rotated into the elongated horizontal aperture 435, thus locking the cover 422 to the container 414. This retains the cord 410 within the slot 420 while the plugs 412 may be inside or outside the container 414 as desired.

The cover 422 can be unlocked when desired and moved to an open position spaced away from the opening of the container 414. This permits the plugs 412 to be rearranged as desired within or outside the container 414. The cover can then again be positioned in the closed position on the container 414 and locked closed. This allows the container 414 to be retained on the cords 410 with one or both of the plugs 412 external to the container 414 in the use position or with one or both of the plugs 412 inside the container 414 in the non-use position.

The container 14 and cover 22 in FIGS. 1–7, the container 214 and cover 222 in FIGS. 8 and 9, the container 314 and cover 322 in FIG. 10, and the container 414 and cover 422 in FIG. 11 may be fabricated from a variety of suitable materials. Such suitable materials include, but are not limited to, thermoplastics and metallic mediums.

From the foregoing, it will be observed that numerous variations and modifications may be affected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An apparatus for preventing unauthorized use of an electrical cord and attached plug wherein said use includes connecting the plug to an electrical receptacle, said apparatus comprising:

(a) a container having a geometric shape of a generally right rectangular parallelpiped with height, length, and width dimensions;

said container comprising a plurality of walls including two opposed sidewalls, two opposed end walls, and a bottom wall that together define a storage volume;

said sidewalls and said end walls each having a top edge, said top edges defining an opening to said storage volume;

at least one of said walls having a support shoulder;

one of said walls including a locking catch extending into said storage volume;

one of said walls that is opposite said wall that includes said locking catch having at least one retaining plate extending into said storage volume opposite said locking catch, said retaining plate having a top surface generally aligned with said support shoulder;

each wall of at least one of the pairs of opposed walls defining at least one slot that is open to the top edge of that wall, said slot being of a size and configuration to prevent the passage of the electrical plug while being large enough to allow the passage of the electrical cord through the slot;

(b) a cover comprising a generally rectangular plate having first and second ends and including a key-operated lock mounted to said cover adjacent said first end of said cover;

said key-operated lock including a cylinder with a portion of said cylinder protruding through said cover adjacent said first end of said cover, said key-operated lock further having a rotatable arm on the end of said protruding portion and extending laterally therefrom;

said cover further defining a bottom surface and a latching edge along said second end of said cover, said cover further having a tab extending outwardly of said latching edge, said cover further including a flange parallel to and below said bottom surface and extending outwardly of said latching edge of said cover on at least one side of said tab whereby a portion of the cord can be disposed within one of said wall slots, the plug can be placed within said storage volume of said container, and said container can be locked to prevent unauthorized use of the plug by disposing said cover in a closed position on said container over said opening with a peripheral portion of said bottom surface supported on said support shoulder, with said cover fitting flush against said top edges of said container walls, with said key lock arm engaged under said locking catch, with said flange engaged under said retaining plate, and with said tab extending over one of said wall slots and whereby said cover can be subsequently temporarily removed to permit the plug to be located exterior of said container with a portion of the cord extending through said storage volume and through two of said slots after which said cover can again be locked in said closed position on said container to thereby retain said container on the cord while permitting use of the plug.

2. An apparatus for preventing unauthorized use of an electrical cord and attached plug wherein said use includes connecting the plug to an electrical receptacle, said apparatus comprising:

(a) a container including a bottom wall and a pluraltiy of sidewalls which, in cooperation with said bottom wall, define a generally right rectangular parallelpiped; at least one of said sidewalls defining a support shoulder upon which a cover may be supported when disposed in a closed position so that said cover is flush with said sidewalls, said container defining a storage volume for receiving the electrical cord and attached plug; said container having a top edge defining an opening to said storage volume to permit the placement of the plug in, or the removal of the plug from, said storage volume;

(b) a cover adapted to be positioned relative to said container in (1) a closed position disposed to occlude said opening and (2) an open position spaced away from said opening to permit access to said storage volume, said cover defining a bottom support surface and a latching edge opposite said key-operated lock, having a tab extending outwardly of said latching edge, and including at least one finger generally parallel to, and below, said support surface wherein said finger extends outwardly of said latching edge on at least one side of said tab;

(c) a locking means for locking said cover in said closed position on said container, said locking means comprising a key-operated lock fixed to and protruding through said cover, a rotatable arm operably associated with said key-operated lock, and a locking catch included in one of said sidewalls adapted to cooperate with said rotatable arm, said locking catch including a slot formed in said one sidewall and engageable by said rotatable arm to secure said cover in said closed position on said container; and (d) said container further defining at least two slots each communicating with said storage volume; each said slot being open to the top edge of said container and being adapted to receive a portion of the cord; each said slot being of a size and configuration to prevent the passage therethrough of the electrical plug, and two spaced-apart retaining apertures, said retaining apertures being disposed on opposite sides of said slots, each said retaining aperture being disposed at an elevation corresponding to said cover finger whereby, when said cover is in said closed position and secured with said key-operated lock, said bottom support surface of said cover is received on said support shoulder, said tab is disposed between said retaining apertures and over said slot, and said finger is disposed in said retaining aperture to prevent upward movement of said cover away from said container whereby a distal end portion of the cord and attached plug can be located within said storage volume and said cover locked in said closed position to prevent uunauthorized use of the cord and attached plug and said cover can be subsquently unlocked and located in said open position to permit (1) at least part of the cord and attached plug to be removed from said storage volume and (2) portions of the cord to be disposed within said slots and through said storage volume; and whereby said cover can be subsequently locked again in said closed position with said container then being retained on the cord with said plug being exterior of the container and with portions of said cord received in said slots.

3. An apparatus for preventing unauthorized use of an electrical cord and attached plug as recited in claim 2, wherein said slots are sufficiently large to accommodate movement of the cord through said slots when said cover is locked in said closed position.

4. An apparatus for preventing unauthorized use of an electrical cord and attached plug as recited in claim 2 wherein said cover is hingedly mounted to one of said sidewalls of said container whereby said cover may be pivoted relative to said container between (1) a closed position disposed to occlude said top defining said opening and (2) an open position spaced away from said opening to permit access to said storage volume.

* * * * *